United States Patent [19]

Wolff et al.

[11] Patent Number: 4,668,380

[45] Date of Patent: May 26, 1987

[54] METHOD FOR TREATING SHALE

[75] Inventors: William F. Wolff, Park Forest; John D. McCollum, Naperville, both of Ill.

[73] Assignee: Standard Oil Company (Indiana), Chicago, Ill.

[21] Appl. No.: 541,720

[22] Filed: Oct. 13, 1983

[51] Int. Cl.[4] ..... C10G 1/00

[52] U.S. Cl. ..... 208/430; 208/435

[58] Field of Search ..... 208/11 LE, 11 R, 430, 208/435; 423/129, 130, 132, 119, 115; 75/7

[56] References Cited

U.S. PATENT DOCUMENTS

| | | | |
|---|---|---|---|
| 3,238,038 | 3/1966 | Hunter | 75/7 |
| 3,389,975 | 6/1968 | Van Nordstrand | 423/115 |
| 3,481,695 | 12/1969 | Hite | 423/127 X |
| 3,503,705 | 3/1970 | Tackett, Jr. | 423/130 X |
| 3,510,255 | 5/1970 | Hall et al. | 208/11 R |
| 3,516,787 | 6/1970 | Van Nordstrand | 208/11 R |
| 3,581,823 | 6/1971 | Feurbachor | 208/11 LE X |
| 3,642,433 | 2/1972 | Dyni | 423/119 |
| 3,721,730 | 3/1973 | Haas | 423/130 X |
| 3,859,413 | 1/1975 | Haas | 423/119 X |
| 3,953,317 | 4/1976 | Myers et al. | 208/11 LE |
| 4,176,042 | 11/1979 | Fahlström | 208/11 LE |
| 4,338,185 | 7/1982 | Noelle | 208/11 LE |

*Primary Examiner*—Andrew H. Metz
*Assistant Examiner*—Caldarola Glenn
*Attorney, Agent, or Firm*—John B. Goodman; William H. Magidson; Ralph C. Medhurst

[57] ABSTRACT

A method for producing a kerogen concentrate from oil shale comprises treating shale with an aqueous caustic treating solution to produce a shale product of substantially transformed mineral content, and then treating the shale product with an aqueous acid solution to produce a kerogen concentrate. The acid solution extracts minerals from the shale product to lower the ash content of the kerogen concentrate. A spent acid solution containing the extracted minerals can be treated to recover minerals therefrom.

8 Claims, 3 Drawing Figures

METHOD FOR TREATING SHALE

FIELD OF THE INVENTION

The invention relates generally to chemical treatments of oil shale rock to facilitate extraction of minerals contained in the shale ore. More specifically, it relates to a method for treating shale with an aqueous caustic solution to transform minerals present in the shale into extractable forms which are not extracted into the caustic solution.

BACKGROUND OF THE INVENTION

Oil shale rock represents a large hydrocarbon resource base from which energy can be recovered. The hydrocarbon constituents in shale rock are known as kerogen which is a mixture of hydrocarbons, in either dry or solidified form, produced by sedimentation of organic substances. The kerogen is contained within the interstices of the shale rock matrix and is generally about 15–25 weight percent of the rock. The kerogen is typically converted into shale oil by high temperature retorting of shale. Shale rock also contains other valuable inorganic mineral values such as uranium, copper, nickel, cobalt, molybdenum, vanadium, titanium, iron and aluminum. For example, western Colorado shale generally contains about 3 to about 6 wt. percent aluminum.

Because of the value of shale's kerogen and minerals, methods for extracting kerogen or the minerals are important. Thus, chemical treating methods other than retorting for concentrating the kerogen contained in oil shale have been disclosed. Chemical treatments of oil shale to recover mineral values contained in the shale have also been disclosed.

For example, Hunter, U.S. Pat. No. 3,238,038 discloses a method for recovering a precious metals such as gold and silver from a bituminous shale ore by treating the shale with an aqueous alkaline solution to increase solubility of the precious metal in an aqueous acid solution. The insoluble residue from the alkaline digestion step is then separated and contacted with an aqueous acid solution, which must contain sulfate, nitrate, chloride and iron ions. A solution containing the precious metal is then separated. Hunter does not disclose a technique for concentrating the kerogen in shale nor a technique for recovering minerals other than precious metals.

Huang, U.S. Pat. No. 4,069,296, discloses a method for recovering aluminum from raw or spent oil shale by contacting the shale with aqueous hydrochloric acid, removing the insoluble residues from the acid treating solution, and then precipitating hydrated aluminum hydroxide from the acid treating solution by contacting with an alkaline agent.

Haas, U.S. Pat. No. 3,859,413 extracts some of the alumina from a previously retorted dawsonite-bearing oil shale. Dawsonite is a sodium aluminum carbonate mineral, $NaAlCO_3(OH)_2$, having aluminum concentrations greater than 4 weight percent. Haas employs a dilute alkaline leaching solution containing 5 to 25 grams solid caustic per liter, at temperatures of 5° to 40° C. for short leach periods up to 1 minute.

Rust, et al., U.S. Pat. No. 4,130,627, discloses a method for recovering minerals from fly ash, not shale, by treating a fly ash water slurry with a sodium hydroxide solution at pH 11–14, recovering a solid residue, and then leaching the solid residue with hydrochloric or hydrofluoric acid to form dissolved chloride or fluoride salts of iron, aluminum, and other metals. The solution containing the dissolved salts is then electrolized to plate out at least iron and optionally one or more other metals, and to recover silicone dioxide by precipitation from the electrolysis solution. The electrolysis solution free of silicone dioxide is then treated to precipitate aluminum hydroxide by raising the pH of the electrolysis solution.

Drinker, U.S. Pat. No. 4,026,360, discloses an in situ method for producing a shale oil from a subterranean oil shale deposit. The method comprises contacting the shale deposit with a hot aqueous alkaline solution to form clay-like materials in the deposit which can swell when subsequently contacted with water. Fresh water relatively free of electrolytes is then injected into the deposit to form flow barriers and reduce permeability of the shale deposit. The flow barriers then direct the flow of subsequently injected fluids to produce shale oil.

Fahlstrom, U.S. Pat. No. 4,176,042, discloses a method for recovering kerogen from bituminous sedimentary rock by crushing and finally dividing the rock in a plurality of grinding stages to a sufficient fineness to free the major part of the kerogen present in the rock. The kerogen can than be separated from the rock by emulsification, flotation or density-separation processes. To enable the rock to be finely divided more readily, the rock at least prior to the final one of the grinding stages is subjected to a leaching treatment to weaken mechanical bonds between minerals contained in the sedimentary rock. The leaching treatment is performed at temperatures above 50° C. with acid solutions, "although basic solutions may also be used". Fahlstrom discloses chemical treating only as an aid to a physical separation of kerogen by grinding of the shale rock. Moreover, acid and basic solutions are disclosed as equivalent for kerogen concentration, but acid solutions are preferred by Fahlstrom.

International Patent Application No. WO82/03484, Meyers et al., assigned to TRW, Inc., published Oct. 14, 1982, and titled "Extraction and Upgrading of Fossil Fuels Using Fused Caustic and Acid Solutions" describes a two-step treating method for raw shale ore. The oil shale is first contacted with a fused alkali at a temperature within the range of 250°–400° C. The solid residue obtained is then washed with a dilute aqueous acid solution to obtain a kerogen concentrate. In this method, the severity of the fused alkali treating conditions is such that no water is present in the treating solution nor is any water maintained within the shale being treated. In addition, there is no disclosure of mineral recovery carried out in conjunction with the kerogen concentration.

There are also numerous disclosures involving treating shale which has been previously retorted, roasted, or pyrolyzed with acid or base solutions. Typical such disclosures are found in Van Nordstrum, U.S. Pat. No. 3,389,975; Hite, U.S. Pat. No. 3,481,695; Paul et al., U.S. Pat. No. 3,510,255; Van Nordstrum, U.S. Pat. No 3,516,787; Templeton, U.S. Pat. No. 3,572,838; Ellington, U.S. Pat. No. 3,586,377; Hoss, U.S. Pat. No. 3,859,413. For example, Hite, U.S. Pat. No. 3,481,695 discloses a process in which oil shale is mixed with sodium carbonate or bicarbonate salt, the resulting mixture is retorted to drive off the shale oil, and the solid residue is then leached with water or dilute acid or base to extract some of the aluminum values from the solid residue.

Applicants are not, however, aware of any integrated method for concentrating kerogen contained in raw or spent shale in conjunction with recovering the mineral values contained within the shale. The disclosed methods also do not focus on obtaining a kerogen concentrate of reduced ash content. Therefore, one object of the invention is to obtain an improved kerogen concentrate of reduced mineral content as measured by its ash content. Another object is to recover minerals such as aluminum contained within the shale rock to improve the economics of the treating method.

SUMMARY OF THE INVENTION

The invention comprises a method for treating oil shale by digesting the shale with an aqueous caustic solution under conditions sufficient to transform minerals present in the shale to extractable form without substantial extraction of the minerals into the caustic treating solution to produce a shale product of transformed mineral content. The caustic digestion of the invention has the advantage of maximizing the eventual removal of minerals from the shale to produce a kerogen concentrate of low ash content. The kerogen concentrate can then be retorted in a much smaller retort because of the mineral removal. Moreover, the invention has the advantage of high mineral recovery to improve the economics of shale treating because the shale minerals are not substantially extracted into the concentrated aqueous caustic solution from which mineral removal is more costly due to the large volumes of solution. Not extracting minerals into the caustic treating solution is further advantageous because the minerals can interfere with regeneration of the caustic solution. Instead, the invention permits the minerals in the shale product to be extracted with a dilute acid solution from which mineral recovery is easier. For example, aluminum can be recovered in high yields with the invention from shales which previously were not susceptible to aluminum extraction.

In one aspect the invention thus comprises contacting raw shale with an aqueous caustic treating solution under conditions sufficient to transform minerals present in the shale into acid extractable form without substantial extraction of the minerals into the aqueous caustic treating solution; separating a shale product having a substantially transformed mineral content; contacting the shale product with an aqueous acid solution to extract minerals from the shale product and produce a kerogen concentrate of reduced ash content; and recovering the kerogen concentrate. If desired, the mineral-containing acid solution is subjected to further separation techniques for minerals recovery, and the acid and caustic treating solutions can be regenerated if necessary.

DETAILED DESCRIPTION OF THE INVENTION

Figure 1:
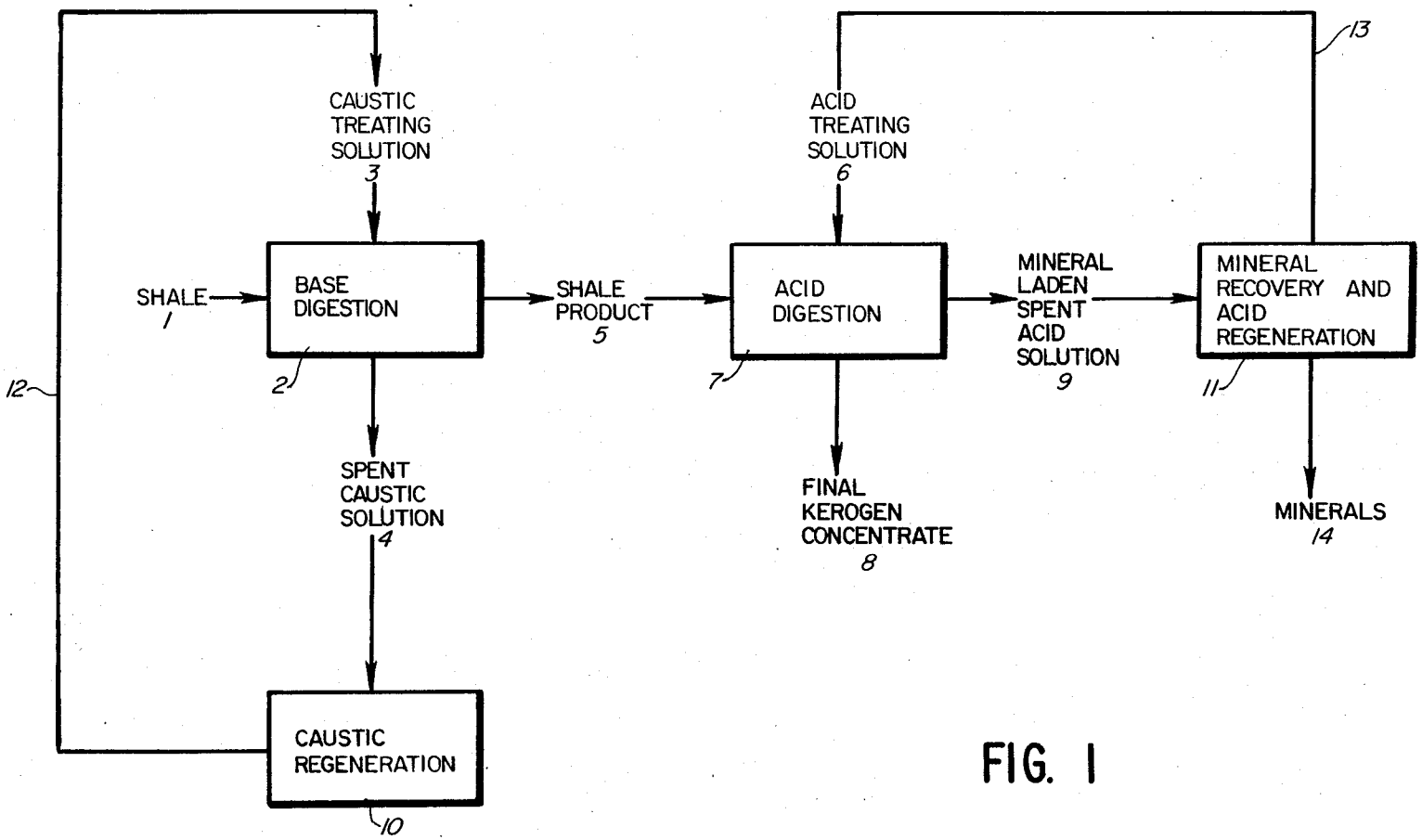
FIG. 1 shows an overall treating method according to the invention.

This invention comprises a method for treating shale rock containing kerogen. The shale starting material can be raw shale which has been mined in a conventional manner. Raw shale from many different deposits can be treated according to the invention. Shale which has been previously beneficiated to upgrade kerogen content or treated to extract kerogen can also be used as the starting material. For example, spent shale from a retort or shale beneficiated in a flotation process which removes gangue material from the shale can be used. It is preferred, however, to use raw shale as the starting material.

The invention broadly comprises digesting shale ore with an aqueous caustic treating solution under conditions which are sufficient to transform minerals present in the shale into extractable forms without substantial extraction of the minerals into the caustic treating solution to produce a shale product of substantially transformed mineral content. The shale product can then be treated to produce a kerogen concentrate of low ash content.

A low ash content in the kerogen concentrate is highly desirable because the size of retort to process the concentrate is related to ash content. Decreases in ash content lower the retort size at significant cost savings.

Applicants have found that the treating conditions in the caustic digestion determine ash content of the kerogen concentrate obtained from the shale product. This is so because the ash content of the kerogen concentrate depends on the amount of minerals left unextracted in the concentrate, and the amount of unextracted minerals in turn depends on the effectiveness of the treating conditions in the caustic digestion for transforming the minerals into extractable forms. In short, the greater the mineral extraction, the lower the ash content in the kerogen concentrate.

The caustic treating conditions are controlled by maintaining water concentration during the caustic digestion within specified limits. The water concentration, which includes both water present in the caustic treating solution and water present in the shale being digested, determines the amount of minerals which are transformed into extractable forms. For example, sufficient water must be present to produce extractable cancrinite, a hydrated alumina-silicate, or other extractable minerals, from the unextractable alumina minerals present in shale. The method of the invention therefore maintains the water concentration above about 5%, preferably within about 5 to about 25%, although greater amounts can be used, by control of caustic concentration in the caustic treating solution, of digestion pressures and of digestion temperature. By such control of the water concentration, a kerogen concentrate with a reduced ash content can be produced with concomitant recovery of the extracted minerals.

This significance of the water concentration is illustrated in Examples 1–20 and FIG. 3, which are discussed below. Briefly, in these examples shale was treated with a 50% aqueous caustic treating solution in the caustic digestion, and the water loss during the digestion was measured. The kerogen concentrates with lower ash contents were seen in those examples where the water concentration, as measured by water lost during the digestion, was within about 10 to about 18%.

As noted, one purpose of the caustic digestion is to substantially transform the minerals contained in the matrix of the shale rock to different extractable forms in the resulting shale product. Then, in a further aspect of the invention, treating of the shale product extracts the minerals to produce the kerogen concentrate of low ash content which can be upgraded directly in a retort.

The subsequent treating is an acid digestion wherein the shale product having a substantially transformed mineral content obtained from the caustic digestion is treated with an aqueous acid solution. The acid solution extracts minerals in ionic form from the shale product into the acid treating solution. The residue separated from a spent acid treating solution containing the minerals is the kerogen concentrate which has a reduced ash content due to the mineral extraction.

In a further aspect the spent acid treating solution which contains the minerals is processed to recover the minerals and to regenerate the acid solution. The mineral recovery and acid regeneration can be performed in conjunction with regeneration of the spent caustic treating solution.

FIG. 1 illustrates the caustic then acid digestion aspect of the invention. Here, shale 1 is shown as feed to caustic digestion 2, and caustic treating solution 3 is fed into the caustic digestion where it contacts the shale. The minerals in the shale are transformed by the digestion into an extractable form, but the minerals are not substantially extracted into the caustic treating solution.

The resulting shale product 5 having a transformed mineral content is separated from the spent caustic solution 4. The spent caustic solution is regenerated in caustic regeneration 10. Caustic 12 from the caustic regeneration is used to make additional caustic treating solution 3.

The shale product 5 is fed to acid digestion 7 where it is contacted with dilute aqueous acid solution 6, and the minerals in the shale product are extracted into the acid treating solution. The kerogen concentrate 8 is separated from the mineral laden spent acid solution 9. The mineral laden acid solution is sent to mineral recovery and acid regeneration 11. Here minerals 14 are recovered and the acid treating solution 13 is regenerated.

To prepare the aqueous caustic treating solutions of the invention, Group 1 or Group 2 metal hydroxides such as sodium, lithium, potassium, or calcium hydroxide can be used. Other alkaline materials such as sodium sulfide, sodium tetrasulfide, sodium hydrosulfide, sodium carbonate, sodium bicarbonate, and sodium silicate can also be used as the caustic to prepare the caustic treating solution. However, sodium hydroxide is preferred because it is easier to subsequently regenerate sodium hydroxide solution for additional treatments of fresh shale than to regenerate other caustic solutions. Calcium hydroxide, for example, may entail operating problems in the regeneration due to the formation of calcium sulfate where sulfate ions are present.

The concentration of caustic on a dry solids weight basis in the aqueous caustic treating solution is the amount which yields a treating solution containing at least about 5 weight % water, and preferably about 5 to about 25 weight % water. The preferred range was determined in Examples 1–20 and FIG. 3, and additional tests by measuring water concentration in the caustic digestion, correlating water concentration to ash content, noting that within the range the ash content of the kerogen concentrate obtained is relatively the lowest and correlating water concentration to the caustic concentration.

Less concentrated solutions of the caustic of about 10 to about 75 weight % caustic can be used with lower reagent costs. However, use of caustic treating solutions containing less than about 75 weight % caustic can require elevated pressure conditions in the caustic digestion, for example, a digestion pressure of about 50 psi to about 250 psi, although higher pressures can be used. The 50 to 250 psi range should be used where the caustic concentration is about 40 to about 60 weight %.

For the preferred caustic, NaOH, the solid NaOH used is thus within the range of about 15 to about 24 molal, and more preferably within the range of about 20 to about 24 molal because the range yields a lower ash content in the kerogen concentrate.

The caustic digestion treating time is about 2 to about 6 hours, although it can be longer. However, contacting times above 24 hours are probably unacceptable for economic reasons.

The caustic digestion is performed at ambient pressure up to about 500 psi, preferably at ambient to about 50 psi. As noted, at caustic concentrations above 75 weight %, the digestion does not require high pressure and is thus performed at about ambient to about 50 psi. This lower pressure condition is preferred, along with high caustic concentrations, in the method of the invention to produce the kerogen concentrate of less than 20% ash content.

The digestion can also be performed under an inert atmosphere, instead of air, to prevent oxidation of the shale product, although this is not essential to the practice of the invention since oxidation does not occur to a substantial extent.

The caustic digestion is performed at about 140° to about 200° C. Below 140° C. the mineral transformation reactions of the digestion are kinetic controlled and require excessive digestion times. At temperatures above 200° C., essentially no water is present in the caustic solution which severely reduces the desired mineral transformations. It is preferred to perform the digestion at about 160° to about 180° C., because over this range water vapor pressure is sufficient to maximize mineral transformations in the shale. At 160° to 180° C., the mineral transformation is equilibrium controlled, but the water concentration is at a level which ensures the transformations are high.

The weight ratio of caustic in the treating solution to the shale is preferably about 0.75 to about 2.5, and was determined by noting that a 20% ash content in the kerogen concentrate is a desired upper limit of ash. To stay below 20% ash, 0.75 is the minimum treating ratio of caustic to shale. The 0.75 weight ratio is also close to the amount of caustic which is stoichometrically necessary to transform silica present in the shale into cancrinite, which can subsequently be extracted. The upper limit on the caustic to shale weight ratio is preferably about 2.5 to permit treating of differing shale deposits, although greater ratios can be used. Examples 21–25 and Table III illustrate the weight ratio range. A more preferred weight range of the caustic to shale is about 1.0 to about 1.5 as seen in results with western Colorado oil shale which showed no decrease in ash content of the kerogen concentrate at treating ratios outside this range.

Thus the caustic digestion preferably comprises contacting oil shale with an aqueous caustic solution of sodium hydroxide, at a temperature in the range of from about 140° C. to about 200° C., with the ratio of the weight of caustic to the weight of oil shale being in the range of from about 0.75 to about 2.5, and with the caustic concentration being in the range of from about 15 to about 24 molal, and at a pressure of about ambient to about 50 psi.

At the end of the caustic digestion, the shale product is separated from the spent caustic treating solution, and is cooled and water washed. The amount of wash can be that equal to the amount of spent caustic solution, and is preferably a minimal amount of water to keep the spent caustic solution as a concentrated solution. The shale product can be dried before further treatment, although the shale product is preferably treated in the acid digestion while it is still damp because higher mineral extraction from the damp shale product occurs.

The shale product differs substantially from the original shale because the minerals in the shale have been substantially transformed. Table I shows the mineral transformations as determined by X-ray diffraction caused by a caustic digestion. The caustic digestions of a Colorado oil shale were performed as in the caustic digestions of Examples 1–20 using 50% on a dry solids weight basis aqueous NaOH treating solution at a temperature of about 165°–175° C. The shale product from two runs under pressure and one at atmospheric pressure were analyzed, and relative amounts of different minerals found in the starting shale were compared to those amounts in the separated shale products.

TABLE I

MINERALS IN SHALE AND KEROGEN CONCENTRATES

| Composition[a] | Quartz | Dolomite | Albite | Analcime | Calcite | Cancrinite | Tobermorite |
|---|---|---|---|---|---|---|---|
| Medium Shale | Major | Major | Major | Major | Minor | — | — |
| Autoclave Product[c] | — | — | — | — | Major | Major | Major |
| Autoclave Product[c] | — | Minor | — | — | Minor | Major | Intermediate |
| Atmospheric Product[c] | — | — | — | — | Major[d] | — | — |

[a]Chemical compositions of the crystalline minerals are as follows: a-Quartz, $SiO_2$; Dolomite, $CaMg(CO_3)_2$; Albite, $NaAlSi_3O_8$; Analcime, $NaAl(SiO_3)_2$—$H_2O$; Calcite, $CaCO_3$; Cancrinite, $(Na, Ca, Al)_8(Si, Al)_{12}O_{24}(CO_3)_2$—$3H_2O$; Tobermorite, $Ca_5(OH)_2Si_6O_{16}$—$4H_2O$.
[b]Pass-14-mesh medium-rich shale.
[c]Medium-rich shale caustic-treated with 50% aqueous NaOH.
[d]Plus several weak unidentified peaks. Under infrared, cancrinite minerals present.

As the data show, the minerals present in the shale were substantially transformed into calcite, cancrinite and tobermorite, all of which are extractable by acid solutions and are not present in the original shale. Although total amounts of minerals were not measured, the data show substantially complete mineral transformations caused by caustic digestion under high caustic concentration with low pressure and under lower caustic concentration with higher pressure. The same substantial mineral transformations to cancrinite, tobermorite and calcite were seen in shale treated at autoclave pressure with both 25 and 35 weight % caustic solutions.

That mineral transformations, not extractions, occur during the caustic digestion is further seen in Examples 26–29. In these, the spent caustic treating solutions and spent acid treating solutions of two shale treatments performed with the method of Examples 1–20 were analyzed by atomic absorption for mineral content. Only six out of 24 minerals had a lower concentration in the acid solution than in the caustic solution.

The mineral transformations due to the caustic digestion is an advantage of the invention. All aluminates and aluminosilicates present in shale including feldspar, are converted into soluble forms. Thus, aluminum recovery can be made from all shales with the invention and is not restricted to Dawsonite-rich shales.

In effect, the shale product separated from the caustic digestion is a silica gel upon which acid soluble minerals and kerogen are deposted. That the shale product's structure appears to be silica gel supporting kerogen and mineral as seen in infrared analysis of the product. All bands corresponding to silica gel (3400, 1625, 1085, 950, 800, and 460 cm−1) were seen in the IR spectrum plus only those associated with kerogen. Because of the shale product's structure, it can thus be used as an active adsorbent for removing acidic and neutral sulfur-containing compounds from liquids or gases such as a flue gas.

The kerogen contained in the shale product showed some changes in elemental and IR analyses after the caustic digestion. It was expected that the severe hydrolysis conditions used in the digestion would hydrolyze the large number of ester and amide links in kerogen to produce a much different kerogen, but the changes observed were chiefly a 5–10% increase in aromatic carbon content, and some slight oxidation of sulfur present.

After the caustic digestion, the washed shale product is then treated in the acid digestion. The purpose of the acid digestion is to extract the minerals which were converted into extractable form by the caustic digestion with an aqueous acid treating solution. The acid digestion destroys the crystalline nature of the shale product to produce an amorphous kerogen concentrate which is separated from the spent acid treating solution. The spent acid treating solution contains the extracted minerals which can be recovered.

The aqueous acid solutions useful in the acid digestion include $H_2SO_3$, $H_2SO_4$, HCl, HF, $HNO_3$, glacial acetic acid and formic acid. It is preferred to use $H_2SO_3$ because bisulfite ion does not precipitate metals, thereby preventing subsequent downstream regeneration problems. Hydroflouric acid in particular presents possibilities of metal salt precipitation.

For any acid used, the concentration is at least about 0.5 molar. In using certain acids the concentration of the acid can affect the success of the acid digestion, as measured by ash content in the kerogen concentrate. Too low an acid concentration does not extract the extractable minerals; too high an acid concentration, on the other hand, can polymerize silicic acid present instead of extracting it.

Thus, for certain acids, the acid treating solution should be maintained within a concentration range of about 0.5 molar up to about 2.0 molar. Acids which should be controlled in this manner are HCl, $HNO_3$ and HF. For $H_2SO_3$, glacial acetic and formic acids however, a concentration of about 0.5 molar up to saturated solutions can be used.

$H_2SO_3$ is further preferred for the acid digestion because it does not exhibit the problems of acid concentration. However, when using above about 1.5 molar $H_2SO_3$, no additional mineral extraction occurred compared to weaker solutions. Thus, for $H_2SO_3$ the preferred concentration range is about 0.5 to about 1.5 molar.

The treating time of the acid digestion is preferably about 1 to about 3 hours, and more preferably about 2 hours. The temperature of the acid digestion was not found to be critical. The acid digestion can be performed at a temperature of about ambient up to about the boiling point of the aqueous acid treating solution used, and lower temperatures in that range are preferred.

For maximum extraction of mineral values from the shale product, vigorous stirring of a slurry of the shale product in the acid treating solution is preferred over a leach or percolation treatment. Vigorous stirring ensures that all extractable minerals and silica are swept into solution and not precipitated to remain in the kerogen concentrate.

After the digestion is terminated, the final kerogen concentrate is separated and fresh water washed. The wash is combined with the spent acid treating solution. The amount of wash is not as important as in the caustic digestion work-up because of the low acid concentrations used. The separated kerogen concentrate is a mixture of silica gel and kerogen; the organic (non-ash) content of the concentrate can be upwards of 80%. The concentrate can be used directly in a retorting process of lower retorting capacity than that used to retort raw shale for conversion of the kerogen to hydrocarbon compounds.

Figure 2:
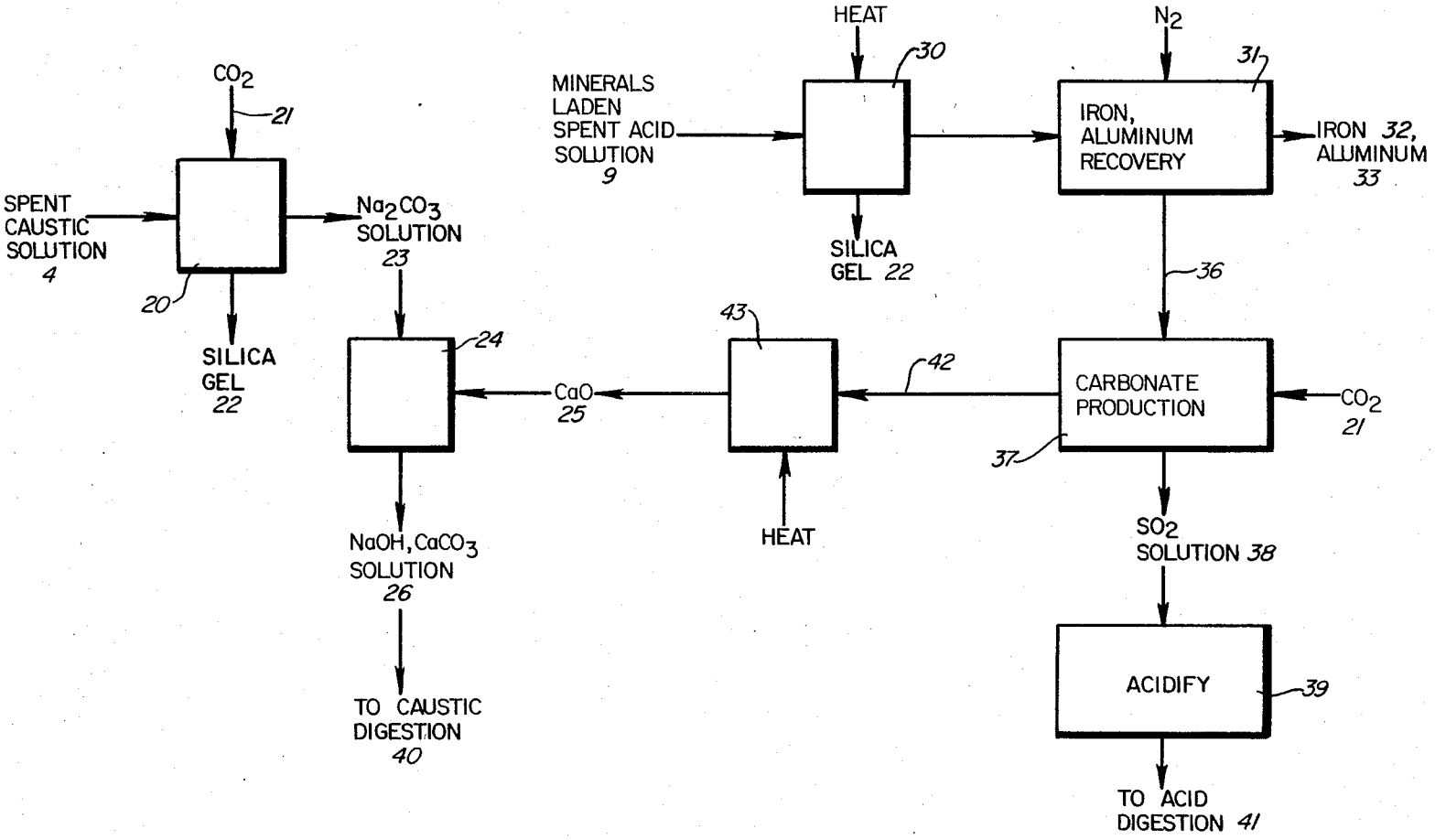
FIG. 2 shows a flow scheme for regeneration of the acid and caustic treating solutions and for recovery of minerals from the spent treating solutions.

After separating the kerogen concentrate, further increases in the economics of the invention are yielded by recovery of the minerals contained in the spent caustic and acid treating solutions with a concomitant regeneration of the caustic and acid treating solutions FIG. 2 shows a preferred embodiment of a regeneration and mineral recovery technique of the invention.

Spent caustic solution 4 is shown as feed to silica gel production zone 20 where excess $CO_2$ 21 is bubbled into the spent caustic solution. Silica gel 22 precipitates leaving sodium carbonate solution 23 which is sent to a caustic treating solution regeneration 24.

The mineral laden spent acid solution 9 containing, for example, aluminum, iron, and calcium enters another silica gel production zone 30 where the solution is heated to about 50°-60° C., air is bubbled in and silica gel 22 precipitates. The resulting acid solution is fed into iron and aluminum recovery zone 31. Here, the pH of the solution is sequentially adjusted for selective precipitation of iron 32 and particularly aluminum 33 in a conventional manner. Other minerals wherre present in significant amounts are recovered in a similar manner at this point. The resulting solution 36 is then fed to carbonate production 37, where $CO_2$ 21 is bubbled into the solution, preferably under neutral to slightly basic pH, to precipitate calcium carbonate and magnesium carbonate 38. Neutral or basic pH is preferred to avoid use of large amounts of $CO_2$. From the carbonate production zone 37, the resulting $SO_2$ solution 38 is removed and acidified 39 to produce the acid treating solution which is returned to the acid digestion 41.

The filtered calcium carbonate and magnesium carbonate 42 is fed to alkaline earth oxide production 43, where heat is supplied to produce mainly calcium oxide 25 since only small amounts of magnesium carbonate are present in feed 42. The calcium oxide reacts with $Na_2CO_3$ 23 in caustic treating solution regeneration 24 to form sodium hydroxide and calcium carbonate solution 26. Calcium carbonate is precipitated and the sodium hydroxide solution is sent to caustic digestion 40.

The following examples illustrate the method of the invention.

EXAMPLES 1-20

Examples 1-20 were run using a western Colorado oil shale. This shale is a lean shale having about 18.0 gallons of oil per ton (determined by modified Fischer assay). All runs started with pass-100 mesh shale. Mineral content of the lean shale included about 5.3% Al, 17.0% Si, 2.4% Fe, 3.5% K, 6.8% Ca, and 0.8% S.

The caustic digestions proceeded by mixing the 100 mesh shale in a tared, stainless steel beaker with a measured amount of 50% on a dry solid weight basis aqueous NaOH solution. In all runs, the NaOH/shale weight ratio was 1.5. The mixture was stirred until the shale was wet, about 5 minutes, the beaker was covered, and placed in a preheated oven. After a selected time, the beaker was cooled and weighed to determine water lost during the caustic digestion. The resulting shale product was then filtered and water washed. The time, temperature and water loss of each run are shown in Table 2.

The damp shale products were passed through a No. 14 sieve and then treated with acid digestions with sulfurous acid. The acid concentration and the acid digestion procedure for each example are listed in Table 2. Seven digestion procedures were used: (1) the shale product was washed repeatedly with acid; (2) excess $SO_2$ was bubbled through a water slurry of shale product, and the solids were filtered and washed with 1.0 molar $H_2SO_3$ and water; (3) as in (2) except the slurry was also stirred; (4) the shale product was slowly stirred with acid solution and the supernatant liquid was filtered off; (5) as in (2) except the shale product was treated in a percolation column; (6) as in (5) except the final $H_2SO_3$ wash was omitted; and (7) damp shale product was rapidly stirred with excess 1.0 molar $H_2SO_3$, filtered, again stirred with acid, and then fresh water washed. The resulting kerogen concentrate for each run was then filtered, air dried, and its ash content was measured. The ash contents are in Table 2.

TABLE 2

EFFECT OF CAUSTIC-TREATMENT ON KEROGEN QUALITY

| | Caustic-Treatment | | | Acid-Treat. | | |
|---|---|---|---|---|---|---|
| Run | Time, hrs. | Temp., °C. | % $H_2O$ off | Conc. | Procedure | % Ash |
| 1 | 16.5 | 171 | 82.5 | Sat. | 5 | 45.4 |
| 2 | 16.0 | 180 | 92.2 | " | 6 | 59.5 |
| 3 | 18.0 | 175 | 93.1 | 1.0 M | 1 | 60.2 |
| 4 | " | " | 90.6 | 1.0 M | 1 | 54.3 |
| 5[b] | " | " | 97.6 | Sat. | 2 | 73.6 |
| 6[b] | " | " | 99.6 | " | 2 | 65.1 |
| 7[b] | " | " | 98.2 | " | 2 | 69.4 |
| 8[b] | " | " | 99.7 | " | 2 | 71.4 |
| 9[b] | " | " | 99.6 | " | 2 | 71.5 |
| 10[c] | 18.5 | " | 101.9 | Sat[c] | 2 | 70.3 |
| 11 | 16.0 | 170 | 98.8 | " | 2 | 70.1 |
| 12 | 5.3 | 180 | 81.1 | " | 2 | 71.8 |
| 13 | 5.1 | 185 | 81.8 | " | 3 | 68.5 |
| 14 | 4.8 | 190 | 81.6 | 1.0 M | 1 | 52.7 |
| 15 | 16.0 | 161 | 86.7 | " | 3 | 44.5 |
| 16 | 57.5 | 153 | 82.1 | " | 3 | 48.0 |
| 17 | 30.0 | 160 | 87.5 | " | 4 | 63.9 |

TABLE 2-continued

| EFFECT OF CAUSTIC-TREATMENT ON KEROGEN QUALITY | | | | | | |
|---|---|---|---|---|---|---|
| | Caustic-Treatment | | | Acid-Treat. | | |
| Run | Time, hrs. | Temp., °C. | % $H_2O$ off | Conc. | Procedure | % Ash |
| 18 | 40.0 | 165 | 84.2 | " | 4 | 65.6 |
| 19 | 40.0 | " | 84.0 | " | 7 | 26.9 |
| 20 | 22.9 | 175 | 88.4 | " | 7 | 24.1 |

Figure 3:
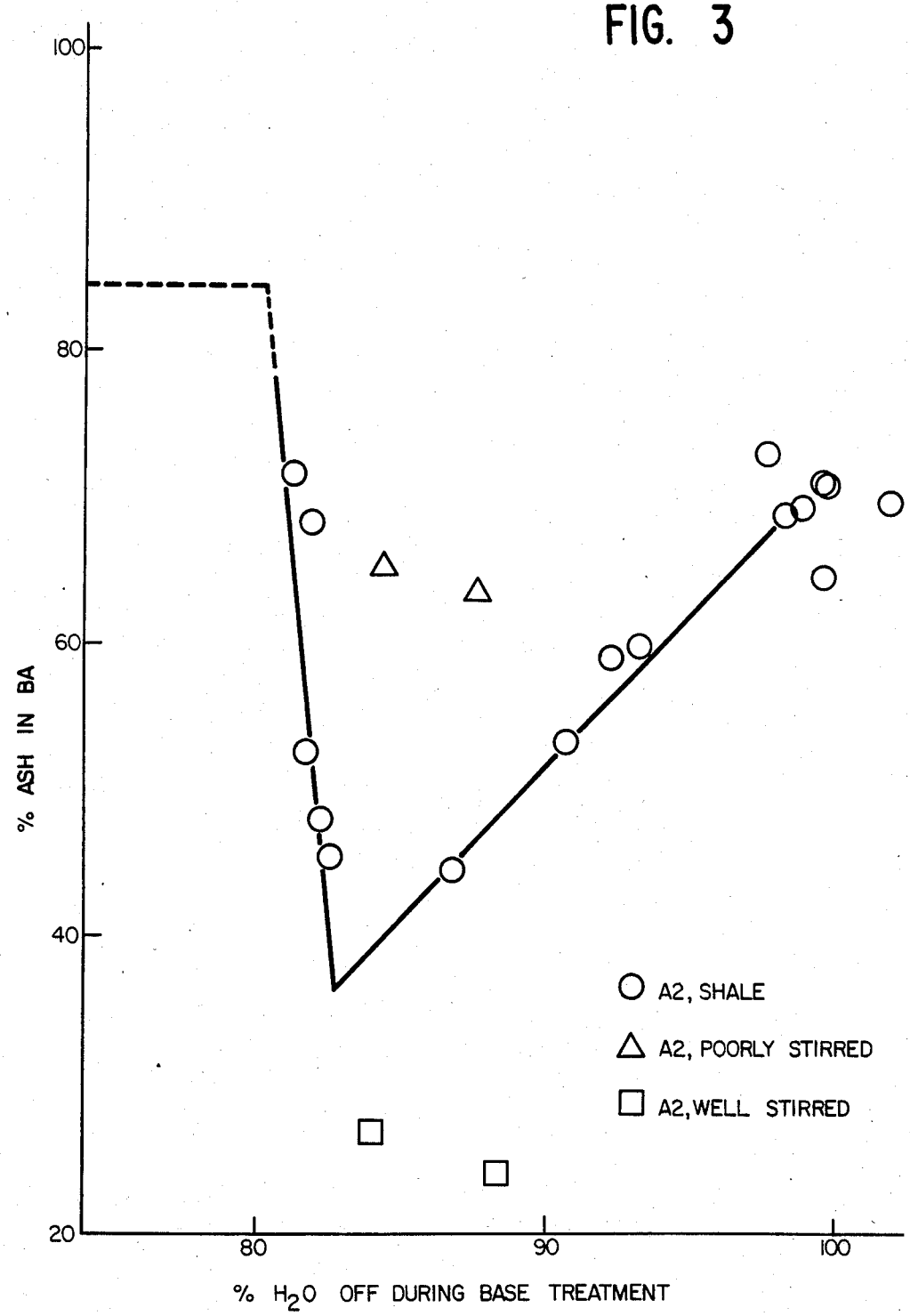
FIG. 3 shows a plot of the correlation between water concentration in the caustic digestion and the ash content of the kerogen concentrate.

[a]Weight loss expressed as percent of $H_2O$ in caustic solution charged.
[b]Shale product was washed with dilute NaOH solution instead of with $H_2O$.
[c]Acetone-water mixture saturated with $SO_2$ FIG. 3 is a plot of percent water lost during the caustic digestion versus the percent ash in the kerogen concentrate. As seen in FIG. 3, when the percent water lost is between about 82 to 90%, the ash content is relatively the lowest. These results indicate that the desired ash content is obtainable by control of water concentration during the base digestion. Later examples will show that ash content is reducible to below 20% with the caustic-acid procedure used in Examples 1–20.

A comparison of Examples 17–18 to 19–20 also show the effect of vigorous stirring during the acid digestion. At about the same water loss condition, 17 and 18, poorly stirred, had much greater ash content than 19 and 20, vigorously stirred. Vigorous stirring or contact during the acid digestion thus yields lower ash content.

EXAMPLES 21–25

Examples 21–25 demonstrate the effect of the caustic solution to shale weight ratio using the same shale in the above examples. The caustic digestions were performed as in Examples 1–20 but were performed at 165° C. for 17 hours. The acid digestions were by stirring well with 1.0M $H_2SO_3$. Table 3 shows the weight ratio, and the % ash and % unextracted aluminum in the kerogen concentrate. As can be seen, at a weight ratio below 0.75, the ash and unextracted aluminum content remains high.

TABLE III

| EFFECT OF CAUSTIC-TO-SHALE RATIO ON ASH CONTENT | | | |
|---|---|---|---|
| Run | NaOH/Shale | % Ash | % Unextracted Al |
| 21 | 1.5 | 27 | 1.1 |
| 22 | 1.0 | 31 | 3.1 |
| 23 | .75 | 31 | 3.4 |
| 24 | .5 | 68 | 34 |
| 25[a] | .5 | 60 | 22 |

[a]Higher severity run: 17 hrs. at 180° C.

EXAMPLES 26–29

Examples 26–29 are atomic absorption analysis of the spent caustic and spent acid solutions, respectively, from two shale treatments, with 26 and 27 of the acid, and 28 and 29 of the caustic. Examples 26 and 29 are from one shale treatment wherein the acid digestion used 1.0M $H_2SO_3$, and 27 and 28 from the other wherein the digestion used 1.0N HCl. The caustic digestions were performed as in Examples 1–20 with 50% NaOH solution, 1.5 NaOH/shale ratios and at 165° for 17 hours. The acid digestions were performed by stirring a slurry of the shale products with the acid. Table IV lists the parts per million parts concentration of twenty-four minerals, and the amounts listed for caustic and acid solutions are on an equal volume of spent treating solution basis.

TABLE IV

| Example | Zn | Mn | Pb | Cd | Cr | Fe | V | Co | Cu | Ni | K | Li |
|---|---|---|---|---|---|---|---|---|---|---|---|---|
| 26 | 1.85 | 3.41 | 1.39 | 0.067 | 4.25 | 230 | 0.181 | 0.117 | 3.06 | 1.56 | 5.1 | 0.29 |
| 27 | 2.99 | 11.9 | 3.11 | 0.132 | 78 | 700 | 0.55 | 0.91 | 1.91 | 34.5 | 11.2 | 0.60 |
| 28 | 1.06 | 0.058 | 0.52 | 0.045 | 0.075 | 2.62 | 0.77 | 0.075 | 0.30 | 0.10 | 88 | 0.55 |
| 29 | 0.485 | 0.039 | 0.52 | 0.045 | 0.113 | 1.25 | 0.56 | 0.075 | 0.30 | 0.10 | 50 | 0.35 |

| Example | Ca | Mo | Mg | Al | Ti | P | Si | B | Ba | Se | Sb | Sr |
|---|---|---|---|---|---|---|---|---|---|---|---|---|
| 26 | 960 | 0.085 | 400 | 285 | 12.8 | 2.22 | 700 | 6.2 | 0.64 | 1.06 | 0.84 | 5.6 |
| 27 | 1260 | 0.347 | 590 | 600 | 24.5 | 4.33 | 1120 | 5.8 | 10.9 | 3.42 | 1.99 | 8.7 |
| 28 | 0.67 | 0.68 | 0.52 | 16.8 | 0.18 | 4.85 | 670 | 8.5 | 0.045 | 0.83 | 0.45 | 0.030 |
| 29 | 1.26 | 0.227 | 0.64 | 57 | 0.18 | 3.42 | 480 | 8.8 | 0.045 | 0.83 | 0.45 | 0.030 |

As is seen in the table, all minerals but vanadium, potassium, lithium (one run), molybdenum (one run), silicon, and boron had higher concentrations in the acid solution than in the caustic solution. In particular, iron, aluminum, magnesium and calcium show much greater concentration in the spent acid. Approximate material balances showed that about 50% silica is extracted into the caustic along with about 86% of the associated potassium; iron, calcium and magnesium were not extracted into the caustic; and aluminum showed 5% (one run) and 25% (the other) extraction into the caustic. The results show no substantial extraction of minerals, particularly non-silicaceous minerals, into the caustic treating solution.

EXAMPLES 30–35

Examples 30–35, detailed in Table V and VI, show the preparation of a kerogen concentrate having less than 20% ash content with the method of the invention. The caustic digestions are in Table V, and all, unless noted, used 50% by weight aqueous NaOH solution, 1.5 NaOH/shale ratios, the lean shale of the earlier examples, 1 atmosphere pressure, and an air atmosphere. Also shown is the amount of damp shale product obtained.

Table VI shows the acid digestions conditions used. Unless noted, all used a slurry treatment of the damp shale products in the acid with good stirring. The weight of kerogen concentrate, % yield, and % ash in the concentrate are also shown.

TABLE V

| CAUSTIC-TREATMENT | | | | |
|---|---|---|---|---|
| Run | Time, hrs. | Temp., °C. | Shale, gr. | Product, gr. |
| 30[a] | 6.0 | 175 | 15.0 | 40.2 |
| 31 | 6.0 | 175 | 15.0 | 40.2 |
| 32 | 23.0 | 175 | 15.0 | 36.9 |
| 33 | 16.0 | 177 | 80.0 | 197.1 |
| 34 | 16.0 | 177 | 80.0 | 197.1 |
| 35[b] | — | 185 | 150.0 | 412.0 |

[a]Caustic/shale ratio of 5.0.
[b]— means not measured.

TABLE VI

| ACID TREATMENT | | | | | | |
|---|---|---|---|---|---|---|
| | | | | Kerogen Concentrate | | |
| Run | Acid | Conc. | Vol., cc | Wt., gr | % Yield | % Ash |
| 30 | $H_2SO_3$ | Sat'd. | 500 | .99 | 6.6 | 12.5 |
| 31 | HCl | 1.0N | >200 | 1.10 | 9.1 | 18.7 |
| 32[a,b] | HCl | 1.0N | — | .67 | 4.5 | 15.4 |
| 33[a] | HCl | 1.0N | — | 1.15 | 9.7 | 17.2 |
| 34 | HCl | 1.0N | — | 5.05 | 9.7 | 12.6 |
| 35 | $H_2SO_3$ | 1.0M | 8000 | 10.5 | 7.0 | 18.3 |

[a]Percolation treatment; volume not measured.
[b]Shale product was unwashed.

As seen in the % ash, all runs had organic content greater than 80%, and two with organic content greater than 85%. The method of the invention can successfully prepare a kerogen concentrate of less than 20% ash content.

The above examples and specification are intended as merely illustrative; the scope of the invention is given by the claims.

We claim:

1. A method for treating oil shale containing kerogen to produce a kerogen concentrate of reduced ash content comprising:

(a) treating raw oil shale with an aqueous caustic solution having a caustic concentration sufficient to substantially transform potentially extractable minerals present in the shale into acid extractable form, without substantial extraction of non-siliceous minerals into the caustic treating solution to produce a shale product of substantially transformed mineral content;

(b) separating the shale product;

(c) treating the separated shale product by contacting it with an aqueous acid solution to produce a kerogen concentrate of reduced ash content and (d) converting the kerogen concentrate of reduced ash content to hydrocarbon compounds by retorting.

2. The method of claim 1 wherein the aqueous acid solution has an acid concentration of at least 0.5 molar.

3. The method of claim 2 wherein the caustic is sodium hydroxide.

4. The method of claim 3 wherein caustic concentration in the aqueous caustic solution is about 15 to about 24 molal NaOH.

5. The method of claim 1 wherein the acid solution is aqueous $H_2SO_3$.

6. The method of claim 5 wherein $SO_2$ is bubbled into a slurry of the shale product and water.

7. The method of claim 3 wherein the acid solution is $H_2SO_3$.

8. The method of claim 1 wherein the caustic in the caustic treating solution is selected from the group consisting of sodium hydroxide, lithium hydroxide, potassium hydroxide, calcium hydroxide, sodium sulfide, sodium tetrasulfide, sodium hydrosulfide, sodium carbonate, sodium bicarbonate, and sodium silicate.

* * * * *